US005144283A

United States Patent [19]

Arens et al.

[11] Patent Number: 5,144,283

[45] Date of Patent: Sep. 1, 1992

[54] ENERGY EFFICIENT ALARM SYSTEM AND REGULATIVE CENTRAL CONTROL UNIT

[75] Inventors: Kenneth P. Arens, 1612 Holley St., Holmen, Wis. 54636; Brian W. Murphy, Silver Springs, Md.

[73] Assignee: Kenneth P. Arens, Holmen, Wis.

[21] Appl. No.: 539,979

[22] Filed: Jun. 18, 1990

[51] Int. Cl.[5] ..... G08B 29/00

[52] U.S. Cl. ..... 340/506; 340/509; 340/546; 340/693

[58] Field of Search ..... 340/506, 693, 546, 509

[56] References Cited

U.S. PATENT DOCUMENTS 4,319,228 3/1982 Daniels ..... 340/546
4,339,746 7/1982 Ulicki et al. ..... 340/506
4,586,028 4/1986 McKinzie ..... 340/546
4,742,336 5/1988 Hall et al. ..... 340/546

*Primary Examiner*—Donnie L. Crosland
*Attorney, Agent, or Firm*—M. Paul Hendrickson

[57] ABSTRACT

An alarm system includes an electronic central controller or control unit with an internal intrusion sensor. The controller is powered by a single nine volt battery. The system can be expanded by adding auxiliary sensors such as sound discriminators, glass breakage sensors and other low power battery operated sensors. The controller can perform all of the functions normally associated with large A.C. powered systems such as factory adjustable entry/exit and reset delays, entrance monitoring, and controlling of lights and message dialers. The system can be adapted for use in mobile environments.

14 Claims, 2 Drawing Sheets

H
RL
E100
D11
M3
I
C4
R4
120
B
D
S
Q
R
CLK
115
F
D6
G
X
D7
116
2
1
P2
R3
R2
R800
B100
P1
C1
R1
C3
C2
D5
V+
A
D4
D8
D1
D2
D3
A100
120
A
R8
J
CLK
R10
R9
R5
C5
114
106
D10
SP3T
DK00
R12
B
R11
Y
112
M2
D
C
R7
R6
D9
C100
100

ENERGY EFFICIENT ALARM SYSTEM AND REGULATIVE CENTRAL CONTROL UNIT

FIELD OF THE INVENTION

The present invention relates to an alarm system, and more particularly, control unit system which is extremely compact, portable, reliable, compatible and easy to install and service, and can be operated by a single nine volt battery.

BACKGROUND OF THE INVENTION

Battery operated alarms serving to detect a single hazardous condition or disturbance and sound an alarm are known in the art. Although requiring very little power, the prior art devices are also relatively simple and have limited alarm features and effectiveness. U.S. Pat. No. 4,758,824 of Young is typical of such devices. The alarm device can be attached to a venetian blind for sensing motion of the blind. U.S. Pat. No. 4,418,337 of Bader teaches an alarm device which can be attached to a person's clothing for monitoring the person's movement. Although both of the devices may be compact and battery operated, they also are very limited in detection application.

The alarm system of the present invention provides a multipurpose, comprehensive and highly efficient battery powered alarm system in contrast to monodynamic, battery operated sensing detection devices of the prior art. The invention affords a battery powered control unit which can have its own intrusion sensor, and can accept inputs/outputs from other sensing devices as well as to activate external alarm and signalling devices.

SUMMARY OF THE INVENTION

The present invention provides a control unit powered by a single nine-volt battery (e.g. such standard sized transistor radio type battery of a low power output such as 550 MA/hour) which when used with current art sensors and alarms allows for a complete 9V battery security system. The electronic central control unit may include an optional internal intrusion sensor. The system can be expanded by adding auxiliary sensors such as sound discriminators, glass breakage sensors, PIR's, motion detectors, and other low power battery operated sensors as well as to activate external alarms and dialers, counters, strobes, etc.

The control unit can perform all of the functions which heretofore could only by achieved by the more sophisticated, expensive, elaborate A.C. power dependent systems of the past (e.g. such as adjustable entry/exit delays and reset, armed status indicators, entrance monitoring and controlling of strobe lights, message dialers, local alarms, and also thermostats for heating and cooling). The control unit thus serves as a battery powered unit possessing multiple security purposes.

The control unit is extremely compact and lightweight while also providing an electronic alarm system and control unit operative at quiescent current draw under 10 uA. The central unit as well as the auxiliary sensors may be operationally utilized for applications wherein it is impractical or unfeasible to rely or utilize an A.C. power source such as remote structure without a utility power source or mobile unit. The control unit and local alarms, strobes, etc., may accordingly be modified for use in an automobile or other mobile conveyances and environments.

The control unit may also be used to effectively function as an entrance monitor or customer counter. The control unit along with associated sensors thereof are easy to mount and install. The control unit may be appropriately fitted with pressure sensitive tapes (e.g. dual lock tapes) to allow for a secure and expeditious installation while also contributing to easy servicing and maintenance (such as an infrequent 9V transistor battery replacement) of the unit. Consequently, the control unit and system may be expeditiously installed upon the protected structure or property and maintained without necessitating costly professionally trained personnel to install and maintain.

The control unit is also compatible with status quo art sensing and alarm devices while still providing absolute 9V battery operation at a low power consumption rate for prolonged operational time periods (e.g. a year and a half or more).

The system and control unit avoids structural damage (e.g. drill holes, etc.) and damaging alterations commonly encountered in the installation of prior alarm systems. The control unit and the alarm system is also immune to power surges, transients, spikes, brownouts, blackouts and lightning which heretofore have a major defect and drawback of the A.C. powered systems. The compactness, low power consumption requirements, versatility and efficacy of the control unit alone or in combination with the auxiliary sensor fulfills a long-felt need heretofore unfulfilled by the prior art alarm systems.

DETAILED DESCRIPTION OF THE INVENTION AND ITS PREFERRED EMBODIMENTS

Figure 1:
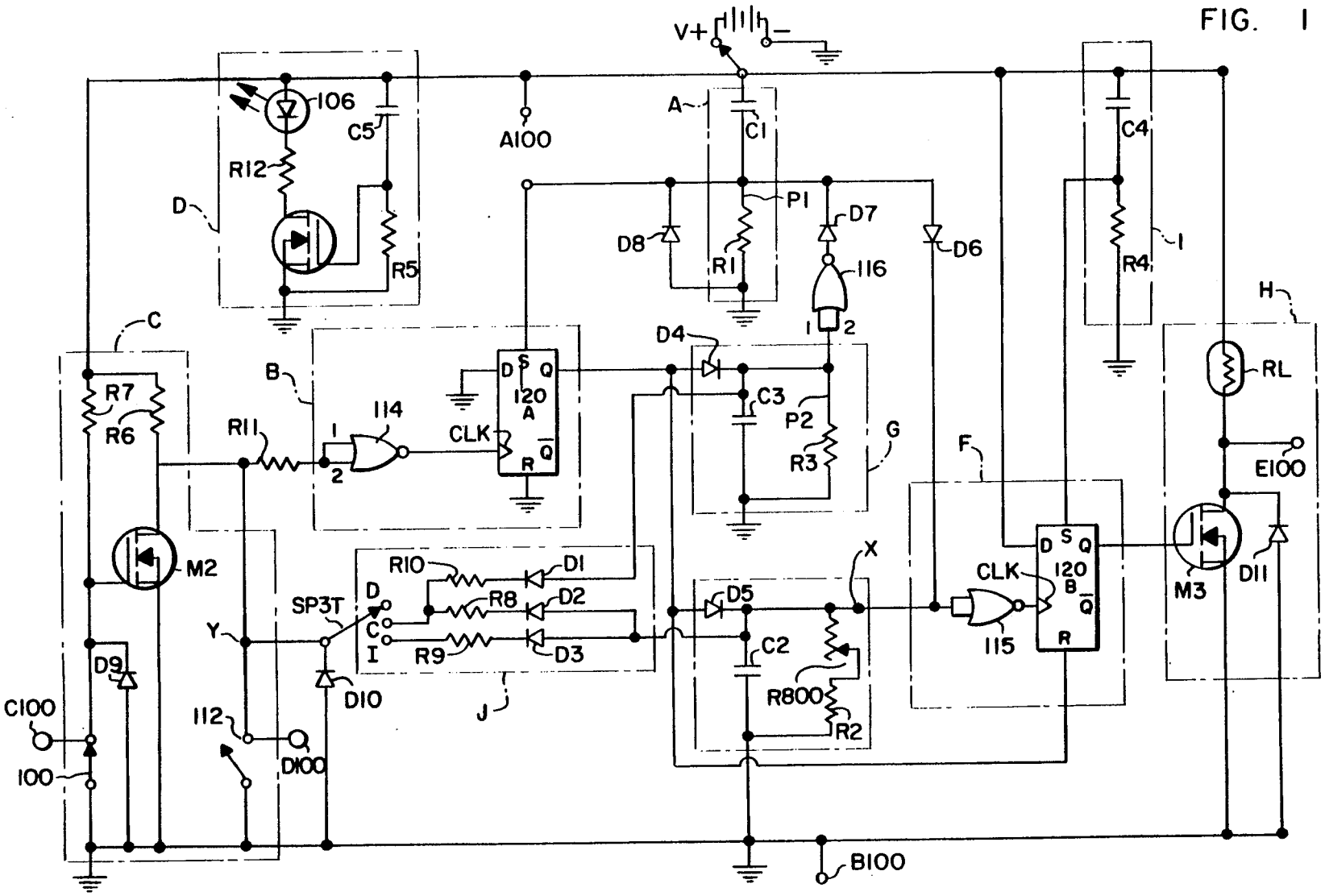
FIG. 1 is a schematic diagram of the circuit of the present invention.

According to the present invention there is provided an alarm system for protecting structures and other personal and real property against loss. With reference to the accompanying figures, the alarm system generally relies upon a compact, d-c powered central control unit (generally designated as 1) having the capability to monitor and regulate a plurality of sensory devices (not shown) which, upon sensing or detecting of a disturbance, relay a sensory signal to the central control unit 1 for further regulative electronic processing (explained in greater detail later) for purposes of triggering a verified alarming signal, all of which is accomplished at an extremely low rate of d-c power consumption. The central control unit 1 is provided with an electronic circuitry (as shown in FIG. 1) and described later) comprised of multiple circuits performing multiple functions integrated and cooperatively associated together so as to uniquely monitor and regulate the system in the creation of a predetermined and controlled alarm signal. Unlike the conventional battery powered alarm systems of the past which typically sound an uncontrolled alarm upon the sensory detection of a disturbance, the central control unit 1 through its multiple and integrated circuitry processes the electronic sensing signal of the sensing device and upon verification by means of its integrated and multiple circuitry as actually warranting an alarming signal, will then output an alarm triggering signal which in turn causes the generation of the alarming signal.

The schematic diagram of FIG. 1 discloses in more detail a preferred embodiment of the central control unit 1 circuitry. For a better understanding and appreciation, the circuitry has been segregated into 10 separate networks (respectively designated as A-J) which are enclosed within the broken lines of FIG. 1.

With particular reference to enumerated designations of FIG. 1, the following electronic components (the purpose and function which will be later described in greater detail) may be effectively utilized in the fabrication of a preferred embodiment of the control unit:

NOR Gates 114–116 are of CMOS CD4001UBE type such as currently manufactured and distributed by RCA and MOTOROLA.

CMOS device 120 (contains two D flip-flops 120A and 120B) is of the CD4013B type such as currently manufactured and distributed by National Semiconductor, Inc.

diodes D1–D10 are of IN4148 type.

diode D11 is of 1N4001 type.

Mosfets M1 and M2 are of the N-channel 1RFD1Z3 mosfet type.

Mosfet M3 is an N-channel 1RFD110 mosfet type.

Resistor RL is a Piezo-ceramic siren of a 100 dB min., ~9 VDC, IT = ~100 MA, and ~2.5 Khz specification.

Resistors (R1–R12) are 0.125 watt and 5% tolerance type.

Capacitors (C1–C5) in UF are WVDC 16 tantalum type with a ±10% tolerance.

The circuitry of each network (A-J) and the current flow therebetween may be more fully appreciated by initially referring to Network C of FIG. 1 which serves as an intrusion sensing network. The intrusion sensing Network C can detect intrusion from both normally closed (N.C.) as well as normally open (N.O.) systems. The circuit can handle multiple N.C. and N.O. switches simultaneously. Resistor R7 is connected to the gate to mosfet M2. Normally closed switched 100 is associated with a magnetic reed switch or PIR (not shown) and is also connected to the gate of mosfet M2. Normally open switch 112 may also be associated with an intrusion detection device such as a magnetic reed switch or PIR. Additional sensors can be connected in parallel with switch 112 and in series with switch 100. Resistor R7 with switch 100 biases mosfet M2 off. R6 in combination with switches 100 and 112 control input 2 on NOR gate 114. If 112 closes, all voltage will be across R6. When switch 100 opens point Y of Network C goes low (unless during exit delay), NOR gate 114 toggles high and clocks 120A. The value of R6 and R7 is important to the biasing of M2 and battery life.

Network B serves as an intrusion clocking circuit. The network consists of NOR gate 114 and D flip-flop 120A. The D and $\overline{R}$ pins of the D flip-flop 120A are grounded. Output $\overline{Q}$ of 120A is not connected. Input S of 120A is kept high during the exit delay period to prevent unwanted clocking of the CMOS device 120 which will be more thoroughly discussed later in the description of Network A. NOR gate 114 is used to clock the CMOS device 120 through input CLK. Input 1 of NOR gate 114 is tied to input 2 (input 2 was previously described under Network C). The remaining D flip-flop in the CMOS 120 device will be discussed in the description of network F.

Network D is the visual on/off status and low battery indicator circuit. L.E.D. 106 is connected to mosfet M1 via current limiting resistor R12 (Network C). When on/off switch 121 is set to 9V, the gate of mosfet M1 goes high and is held high until capacitor C5 is charged through resistor R5. When C5 is charged, the gate of M1 goes low and L.E.D. 106 is turned off. This process takes approximately 3 seconds; thus, illuminating the LED indicator for approximately 3 seconds. Turning off LED 106 after approximately 3 seconds increases battery life tremendously, and reduces visibility of the alarm to a would-be intruder. When the battery reaches 4.5 volts or less in potential, the LED will briefly illuminate and be very faint when switch 121 is first turned to +9V, thus indicating an armed SCU and a low battery.

Network E is an adjustable entry delay circuit. Capacitor C2 is connected in parallel with resistor R2 and adjustable resistor R800. When switch 121 is set to +9V, output Q of CMOS device 120A goes high immediately. This forward biases diode D5, charges up capacitor C2 almost instantly, and current flows through R800 and R2 to ground. When entry is sensed, output Q of CMOS device 120A goes low. Diode D5 becomes reverse biased and capacitor C2 begins discharging through resistors R800 and R2. Adjustable resistor R80O controls the rate of discharge of C2. The delay can be from approximately 7–25 seconds. After the delay periods CMOS device 120B of Network F will be clocked. The operation of Network F will be more fully described later. The values of C2, R2 and R800 are very important to control standby current and keep under 10 uA.

Network A serves as an exit delay circuit. Capacitor C1 is connected to on/off switch 121. Resistor R1 is connected between the negative terminal of capacitor C1 and ground. When switch 121 is set to +9V capacitor C1 charges up through resistor R1 to ground. When C1 charges through R1, it creates a voltage drop across R1, which is connected to the S input on the D flip-flop (120A). This "sets" the flip-flop instantly so that the Q output is high. The flip-flop cannot be "clocked" by NOR Gate 114 (or sensors) until after exit delay (C1 is charged up). If the S input on the flip-flop is high the Q output cannot be "clocked". The exit delay period can be made adjustable by adding an adjustable resistor in series with R1 at point P+1.

Network G functions as an in series reset timing circuit. Diode D4 is connected to the positive terminal of capacitor C3 which is connected in parallel with resistor R3. When output Q of CMOS device 120 goes high as a result of switch 121 being set to +9V, diode D4 is forward biased. Capacitor C3 charges up and current flows through R3 to ground. This makes inputs 1 and 2 of NOR gate 116 go high, which forces the output low. When an intrusion is sensed, output Q of CMOS device 120A goes low. Diode D4 is reverse biased and isolates Network G. Capacitor C3 begins discharging through resistor R3 for a set period of time (2–3 minutes). Inputs 1 and 2 of NOR gate 116 then go low which forces the output high. This causes diode D7 to be forward biased and as a result current flows through resistor R1 making the S input high thereby causing output Q of CMOS device 120A to go high and resetting the alarm for the next intrusion. The reset timing circuit can be made adjustable by adding an adjustable resistor at point P2.

Network F contains the siren trigger circuitry. The network consists of NOR gate 115 and D flip-flop device 12OB. Output $\overline{Q}$ of the D flip-flop 12OB is not connected. Output Q of the D flip-flop 120B is connected to the input of mosfet M3 (Network H). The set input (Input S) of the D flip-flop 120B is obtained from Network I and the reset input (Input R) is obtained from output Q of D flip-flop 120A. The data input (Input D) of the D flip-flop 120B is tied to positive voltage. The clock (CLK) is driven by NOR gate 115. Inputs 1 and 2 of NOR gate 115 are tied together and will toggle to a high output only after entry (Network I) delay (point X goes low).

As will be recognized, all chips are connected in the standard manner with power supply and ground connections which connections for purposes of simplification and appreciation of the circuitry are not shown.

The entrance monitoring function is controlled by network J. Network J utilizes two RC time constant paths to quickly pulse the gate of mosfet M3 high and then reset the circuit. Capacitor C2, diode D2, and resistor R8 makeup one time constant path. Assuming switch SP3T is in the C or chirp position, 0.056 seconds after node Y goes low from a sensor, capacitor C2 is discharged and the siren sounds. Capacitor C3, diode D1 and resistor R10 make up another time constant path. At 0.0946 seconds after point Y goes low, and approximately 0.0386 seconds after the siren starts sounding, capacitor C3 is drained and the circuit resets. Thus, the two RC time constant paths cooperate to pulse the gate of M3 causing the siren to chirp.

Network H serves as a driving circuit for a piezo-ceramic siren RL. The gate of mosfet M3 is connected to the Q output of 120B. The drain of mosfet M3 is connected to the negative terminal of piezo-ceramic siren RL and the positive terminal of siren is to +V. When the gate of M3 is made high, M3 turns on and there is a path from ground to the negative terminal of piezo-ceramic siren RL thereby causing the alarm to sound. The piezo-ceramic siren has its own internal driving circuit. The zero leakage current of M1, M2, M3 when off, and the isolation of M1, M2, M3's inputs from there outputs plus the low draw of the CMOS devices (114, 115, 116, 120A, and 12OB), and absence of current paths creates the low standby current.

The actual standby current can be calculated by first dividing VDD by R800+R2, thus; 9V/3M=3 uA.

Another current path is through R7 to ground;

9V/3.6M=2.5 uA

One other current path exists from the Q output of CMOS device 120 through R3 to ground;

9V/4.7M=1.9 uA Adding in the current draw of the CMOS device (~0.1 uA) gives a total standby current of ~7.5 uA.

Network I is the aural armed status circuit. The network consists of capacitor C4 and resistor R4. When capacitor C4 is charging up through resistor R4 it pulses the D flip-flop 120B Q output. When S and R are both high, Q will go high.

In operation, the circuit is in standby after an exit delay by placing switch 121 in the +9V position. When the control unit is turned on using switch 121, the siren emits a chirp to confirm the armed status. When an intrusion is sensed by any of the sensors associated with the intrusion sensing Network C, inputs 1 and 2 or point Y of NOR gate 114 go low, causing the output of NOR gate 114 to go high. This clocks CMOS device 120A and causes the Q output to go low.

The points designated A100 through F100 are used as hookup points for the auxiliary sensors and devices. Point C100 is to be used with sensors which have normally closed loops. Point D100 must be used with sensors which have normally open loops. Point B100 is a ground connection terminal and A100 is connected to battery 123 via switch 121 for accessory hookup. Point E100 is an output terminal that is activated when the gate of M3 is made high, thus, activating an accessory device plugged into output E100.

Switch SP3T can also be set in positions D (delay mode) or I (instant mode). When switch SP3T is set to instant mode the alarm will sound immediately upon the sensing of an intruder thus bypassing the entry delay (Network E). This mode is most effective for glass breaking sensors where an entry delay period is not needed. When switch SP3T is set in the delay mode, the alarm will sound only after the entry delay period. D is not connected to the circuit in Network J.

Figure 4:
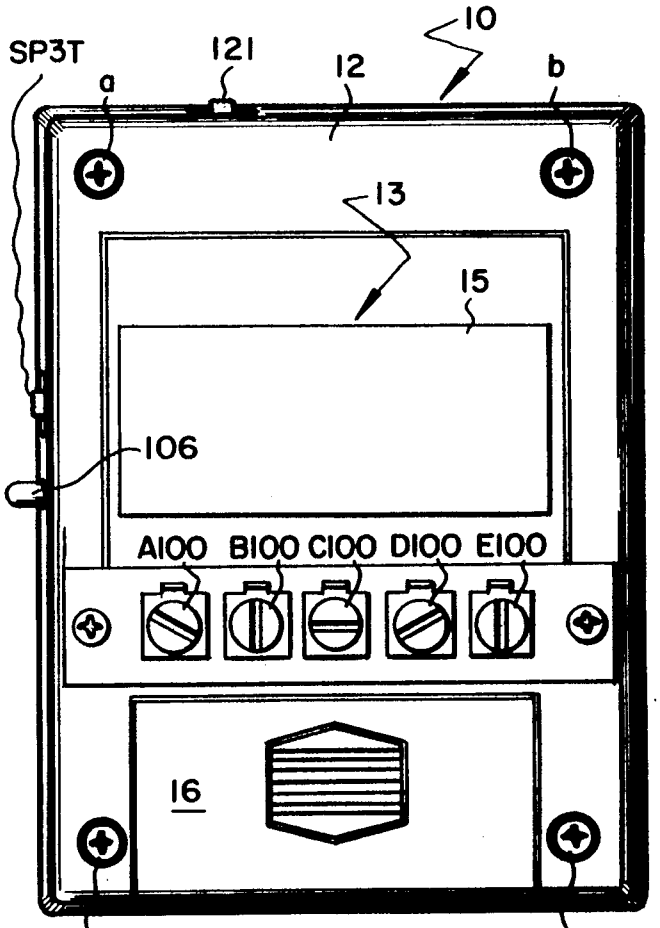
FIG. 4 is a rear view of the control unit of the present invention.
Figure 3:
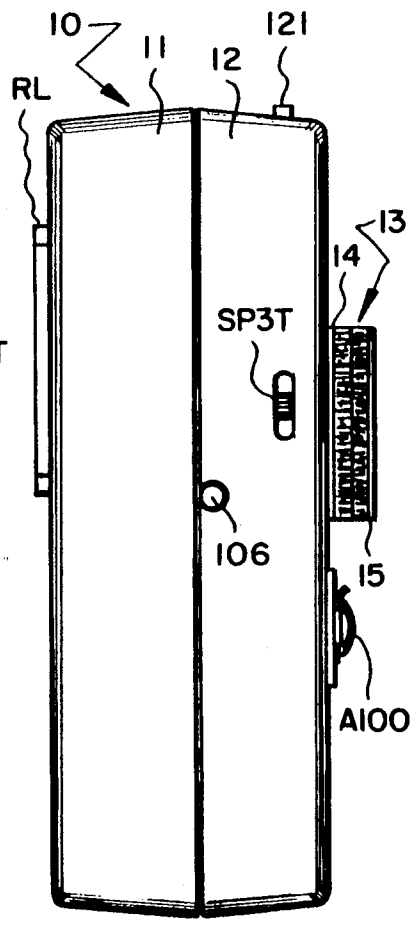
FIG. 3 is a side view of the control unit of the present invention.
Figure 2:
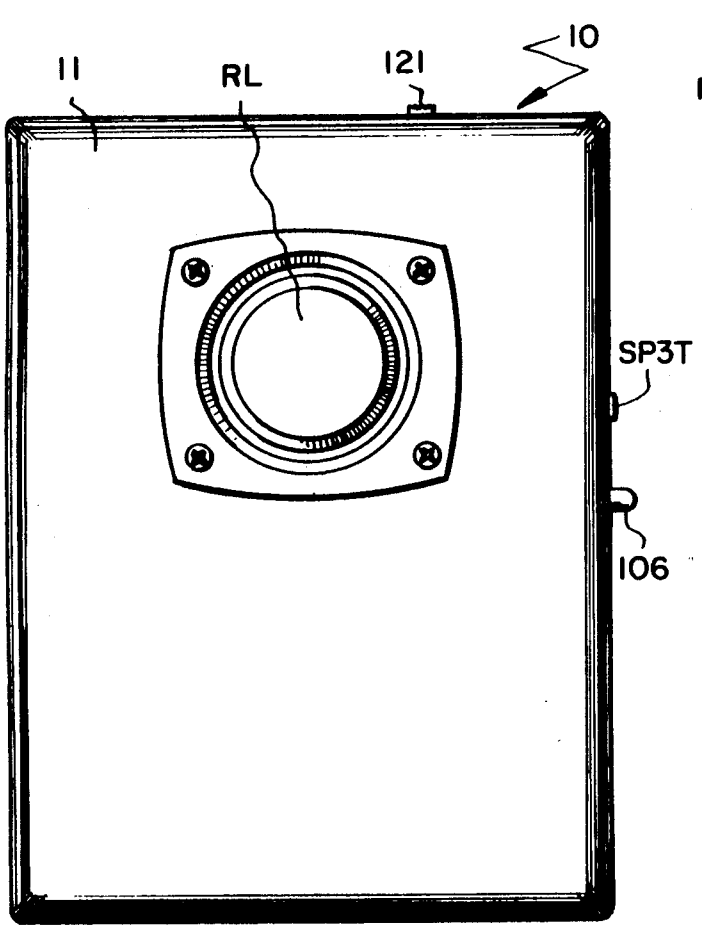
FIG. 2 is a front view of the housing of the control unit of the present invention.

The circuitry of FIG. 1 may be placed in an extremely compact housing 10 as illustrated in FIGS. 2-4. The depicted housing 10 includes a front half section 11 and a rear half section 12 (attached together by screws a, b, c, and d) for accessing to its internal circuitry. The control unit front view (e.g. see FIG. 1) and side view (FIG. 2) externally shows switch 121, LED 106, switch SP3T and piezo-ceramic siren RL. As previously mentioned switch SP3T is the triple throw, single pole switch which allows the unit to be set in the delay D, instant I or chirp C position. In the delay mode D, when the unit is switched "on" at switch 121, the unit allows for a delayed time for leaving or entering the monitored area without sounding siren RL. If switch SP3T is switched to the instant I position, the siren RL will immediately sound upon intrusion into the monitored area while in the chirp C position the siren will briefly chirp upon entry to or exit from the monitored area. The LED 106 will briefly illuminate when the unit is first turned on and will faintly glow when the battery is low or needs replacement.

The rear view of FIG. 4 further illustrates the compactness as well as simplicity of connecting the control unit to external sensory devices via the accessory connecting or terminal points A100 +V), B100 (ground), C100 (for N.C. sensors), D100 (for N.O. sensors), and E100 (output). It will be further observed from FIG. 4, the rear panel section 12 also includes a pressure fastener combination 13 (e.g. such as VELCRO, DUAL-LOCK TAPE, etc.) of mating and fastening tapes 14 and 15, one of which 14 is secured onto panel section 12 (e.g. via pressure sensitive adhesive backing) and the other tape 15 also having a pressure sensitive backing (not shown) for ease of mounting onto any structural surface. The rear panel section 12 is also provided with a battery accessing port 16 which affords access to a battery compartment (not shown).

What is claimed is:

1. An alarm system operated under a low rate of power consumption and regulated by a central control unit equipped to monitor multiple sensory devices operatively associated therewith and to regulatively trigger an alarm signal in response to sensing signals detected by said sensing devices, said system comprising:

A) sensing means for detecting and emitting a sensing signal in response to an environmental disturbance;

B) a central control unit for receiving and monitoring the sensing signal which unit includes:

1) first circuit means for generating a first control signal in response to sensing means;
2) alarm detection means for outputting an alarm detection signal in response to said first control signal;
3) means for outputting an alarm triggering signal in response to said alarm detection signal; and
4) second circuit means responsive to said alarm triggering signal for generating an alarming signal; and C) a source of D.C. power for powering said control unit;

with said means for generating a first control signal comprising a normally off mosfet, said mosfet having a gate, a source, and a drain, said mosfet having its gate connected to said source of D.C. power and its drain connected to said alarm detection means, at least one intrusion sensing device having a normally closed switch connected to the gate of said mosfet, at least one intrusion sensing device having a normally open switch connected to the drain of said mosfet, whereby said first control signal will be generated in response to an intrusion detected by any of said intrusion sensing devices.

2. The alarm system of claim 1 where said system has indicating means connected to said source of D.C. power for indicating operational status.

3. The alarm system of claim 2 where said means for indicating operational status includes means for indicating low battery condition.

4. The alarm system of claim 2 where said indicating means comprises an LED, said LED connected in series with a mosfet, whereby said mosfet turns off said LED after a predetermined period following activation of said alarm system.

5. The alarm system of claim 1 where said sensing means includes an intrusion sensing means and said source of D.C. power consists of a 9 volt D.C. dry cell battery.

6. The alarm system of claim 1 where said first circuit means and said second circuit means have a quiescent operating current of less than 10 uA.

7. The alarm system of claim 1 wherein said alarm triggering signal is output to said second circuit means after a predetermined time delay.

8. The alarm system of claim 1 where said system has a quiescent operating current of less than 10 microamps.

9. The alarm system of claim 1 where said system includes entrance monitoring means, said entrance monitoring means comprising:

switching means for switching to said second circuit means;

said switching means connected said first circuit means and having first and second states;

whereby said second circuit means generates an alarming signal in response to said first control signal when said switching means is in said second state.

10. The system of claim 9 wherein said pulse generation means includes first and second timing circuit means.

11. The system of claim 9 wherein said first timing circuit means activates said second circuit means and said second timing circuit means deactivates said second circuit means.

12. A control unit operating under a D.C. power source for an electronic alarm system comprising:

A) means for receiving an intrusion detection signal and outputting a first control signal in response thereto; first circuit means connected to receive said first control signal and outputting a second control signal in response thereto;

B) timing circuit means connected to receive said second control signal and to output an alarm detection signal in response thereto after a predetermined delay;

C) second circuit means responsive to said alarm signal for generating an alarming signal; and D) means for indicating operational status of said unit which includes indicating means connected to said D.C. power source, said indicating means comprised of an LED, said LED connected in series with a mosfet, whereby said mosfet turns off said LED after a predetermined period following activation of said alarm system.

13. The control unit of claim 12 wherein said circuit means has a quiescent operating current of less than 10 uA.

14. The control unit of claim 12 wherein said unit has a quiescent operating current of less than 10 microamps.

* * * * *